US010371138B2

(12) United States Patent
Golding et al.

(10) Patent No.: US 10,371,138 B2
(45) Date of Patent: Aug. 6, 2019

(54) ROTARY PUMP

(71) Applicant: CHARLES AUSTEN PUMPS LTD., Surrey (GB)

(72) Inventors: James Andrew Golding, Berkshire (GB); William Eric Shepherd, Surrey (GB)

(73) Assignee: CHARLES AUSTEN PUMPS LTD., Surrey (GB)

( * ) Notice: Subject to any disclaimer, the term of this patent is extended or adjusted under 35 U.S.C. 154(b) by 276 days.

(21) Appl. No.: 15/314,722

(22) PCT Filed: May 29, 2015

(86) PCT No.: PCT/EP2015/062018

§ 371 (c)(1),
(2) Date: Nov. 29, 2016

(87) PCT Pub. No.: WO2015/181373

PCT Pub. Date: Dec. 3, 2015

(65) Prior Publication Data

US 2017/0198686 A1 Jul. 13, 2017

(30) Foreign Application Priority Data

May 29, 2014 (GB) ..... 1409534.3

(51) Int. Cl.
*F04B 43/14* (2006.01)
*F04B 43/12* (2006.01)
(Continued)

(52) U.S. Cl.
CPC ..... *F04B 43/1207* (2013.01); *F04B 9/045* (2013.01); *F04B 43/009* (2013.01); *F04B 43/14* (2013.01)

(58) Field of Classification Search
CPC .... F04B 43/1207; F04B 9/045; F04B 43/009; F04B 43/14
See application file for complete search history.

(56) References Cited

U.S. PATENT DOCUMENTS 1,707,283 A * 4/1929 Shapiro ..... H04R 7/12 181/171
1,877,804 A * 9/1932 Bruijnes ..... H04R 7/20 181/172

(Continued)

FOREIGN PATENT DOCUMENTS

DE 1078447 B 3/1960
EP 0770183 B1 4/1998

(Continued)

OTHER PUBLICATIONS

International Search Report dated Oct. 2, 2016 for Application No. PCT/EP2015/062018.

(Continued)

*Primary Examiner* — Peter J Bertheaud
*Assistant Examiner* — Dnyanesh G Kasture
(74) *Attorney, Agent, or Firm* — Patterson + Sheridan, LLP

(57) ABSTRACT

A rotary pump in a housing which defines an annular chamber with an inlet and outlet port which are located on either side of a partition which extends across the chamber. A flexible annular diaphragm forms one side of the chamber and faces a wall on the housing which forms the second side of the chamber. The diaphragm is sealed at its innermost and outermost edges to the housing and has legs extending away azimuthally around and integral with the diaphragm. A swashplate is connected to the legs of the diaphragm such that in use, movement of the swashplate causes the diaphragm to press precessively against the wall of the housing (Continued)

to force fluid drawn in at the inlet on one side of the partition around the chamber and to expel the fluid at the outlet at the other side of the partition.

9 Claims, 4 Drawing Sheets

(51) Int. Cl.
*F04B 9/04* (2006.01)
*F04B 43/00* (2006.01)

(56) References Cited

U.S. PATENT DOCUMENTS 2,752,852 A 7/1956 Offutt
3,058,428 A 10/1962 Gemeinhardt
3,669,578 A 6/1972 Nameny
3,922,119 A 11/1975 Rosenquist
5,466,133 A 11/1995 Tuck, Jr.
5,533,886 A * 7/1996 Von Der Heyde ..... F04B 43/1207 417/413.1
6,513,623 B2 * 2/2003 Sugiyama ..... H04R 9/06 181/157
8,015,912 B2 * 9/2011 Stimpson ..... F04B 43/02 417/413.1
2004/0182237 A1 * 9/2004 Headley ..... F04B 43/0054 92/99
2005/0115402 A1 6/2005 Hembree
2012/0163999 A1 6/2012 Becker

FOREIGN PATENT DOCUMENTS

JP S5775230 A 5/1982
JP S5835288 A 3/1983
WO 9600850 A1 1/1996

OTHER PUBLICATIONS

English translation of First Office Action dated Dec. 22, 2017, issued in corresponding Chinese patent application 201580028371.3.
English translation of Office Action dated Dec. 4, 2017, issued in corresponding Japanese patent application 2016-569034.

* cited by examiner

ROTARY PUMP

The present invention relates to rotary pumps.

Rotary pumps are based on a concept of a rotating element that mechanically transports a volume of medium from a suction (inlet) end of the pump to the discharge (outlet) end during a revolution. A single revolution displaces a fixed volume of liquid. Typical examples of rotary pumps are diaphragm pumps, gear pumps, and rotary vane pumps.

An example of an existing rotary pump design is shown in CN 202483845. This discloses a pump employing a swashplate which engages pistons to move a diaphragm up and down inside the pump.

Another pump design is shown in EP 0,819,853. This discloses a pump comprising a tubular flexible diaphragm whose central portion is caused to orbit by an eccentrically driven bearing.

According to the present invention, there is provided a rotary pump according to claim 1.

The present invention uses the face of the diaphragm to open and close the inlet and outlet ports in the correct manner for efficient pumping operation.

Because a portion of the diaphragm is always pressed against the opposite wall of the housing, the inlet and the outlet are always isolated from each other. Therefore the need for separate inlet and outlet valves in the pump is removed. Because no such valves are needed, the pump of the present invention also has the advantage that it is bi-directional.

To minimise any fluid which may leak around the diaphragm from coming into contact with the swashplate and other components of the pump, the pump may further comprise a sealing ring between the swashplate and the diaphragm.

The sealing ring preferably comprises an opening through which the swashplate connects with the diaphragm.

The swashplate is preferably connected to the diaphragm by a snap-fitting to avoid the use of fastening means which could become dislodged during use of the pump.

The wall on the housing forming the second side of the chamber may be tapered towards the swashplate to increase the displacement provided by the pump.

Preferably, the pump may further comprise a rotatable shaft for moving the swashplate. In this case, the swashplate may be coupled to the shaft via an eccentric bearing which is eccentric to the rotation axis of the shaft.

To reduce unwanted oscillations during use of the pump, the shaft may be coupled to the housing via a coupling bearing.

The shaft may further comprise a tube member for rotatably connecting the shaft to a motor. This allows the shaft to be connected to a variety of different motors. In this case, the tube member may be made of a flexible material, for instance silicone, to increase its durability.

The present invention will now be described with reference to the Figures in which.

Figure 1A:
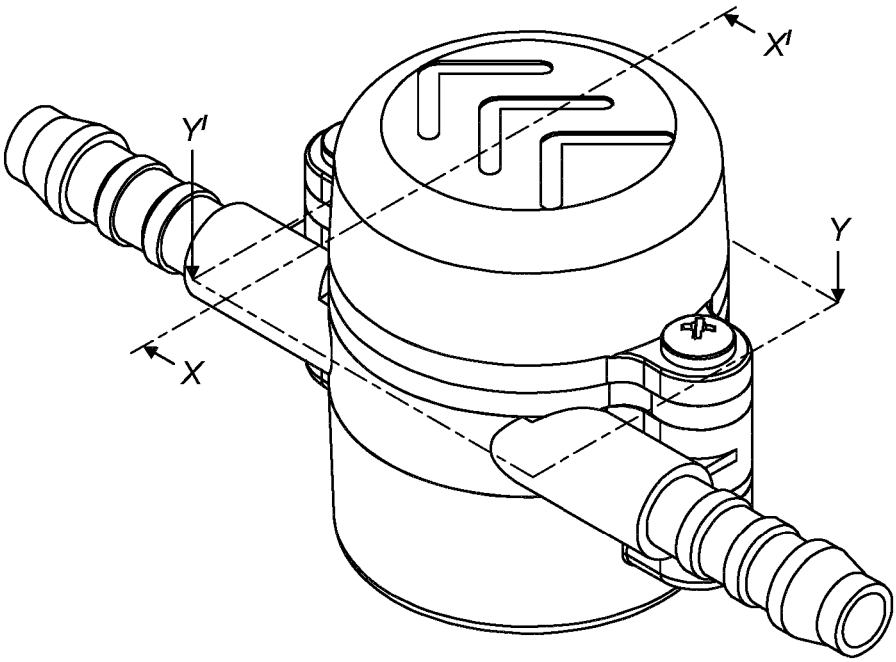
FIG. 1A shows a perspective view of the pump of the present invention.

With reference to FIG. 1A, there is shown a rotary pump. The rotary pump comprises an annular channel 30, for receiving fluid, which is located in a central circular portion 5 of the pump. A fluid inlet 32 connects with a first end of the channel 30 whilst a fluid outlet 34 connects with the other end of the channel. A partition wall 36 separates the two ends of the channel from each other.

An annular diaphragm 1 fits over the channel 30. The diaphragm is flexible and is operable in use to press against portions of channel 30 precessively to squeeze fluid from the inlet, around the channel 30, and out from the outlet.

A sealing ring 2 fits on top of the diaphragm 1 so that the diaphragm is sandwiched between the sealing ring and the channel 30. The sealing ring prevents fluid which may leak around the diaphragm from progressing into the remaining regions of the pump.

Figure 1B:
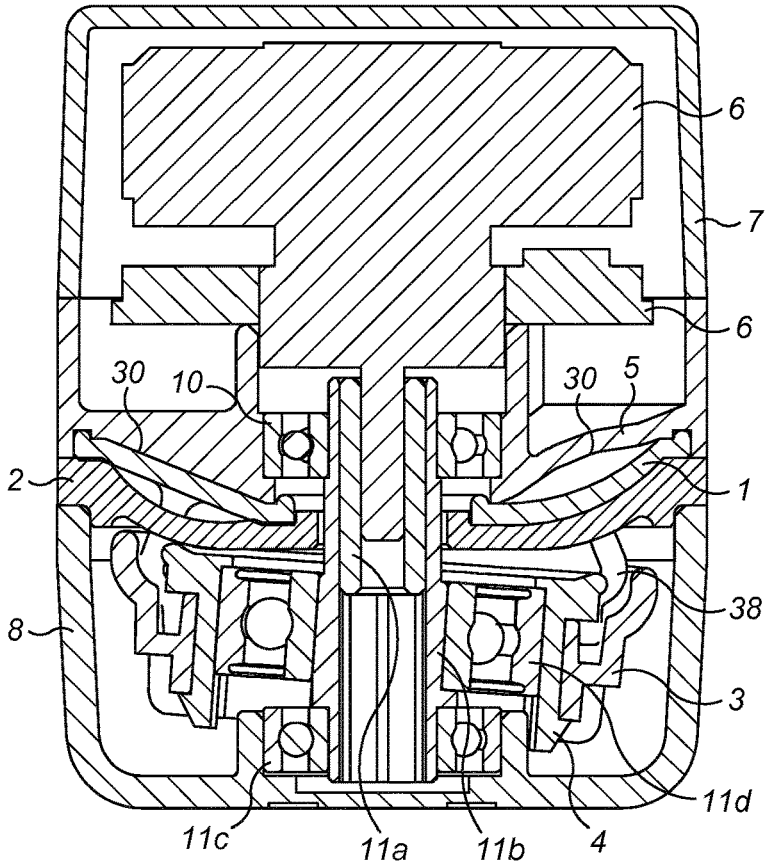
FIG. 1B shows an inverted cross section view of the pump from FIG. 1A taken about the plane X-X'.
Figure 1C:
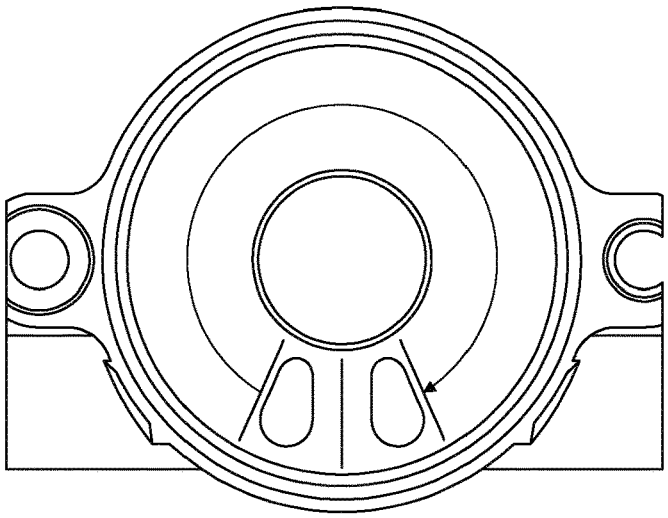
FIG. 1C shows a cross section view of the pump from FIG. 1A taken about the plane Y-Y'. The arrow from FIG. 1C shows the primary direction of fluid flow around the pump.

On top of the sealing ring 2 is a swashplate assembly 50 which is formed of three parts: an outer clamp ring 3, an inner clamp ring 4 and an eccentric shaft assembly 11. The inner and outer clamp rings snap fit together and locate around the eccentric shaft assembly as shown in FIG. 1B. Once assembled, the eccentric shaft assembly 11 prevents the outer clamp ring 3 from being separated from the inner clamp ring 4.

Figure 2:
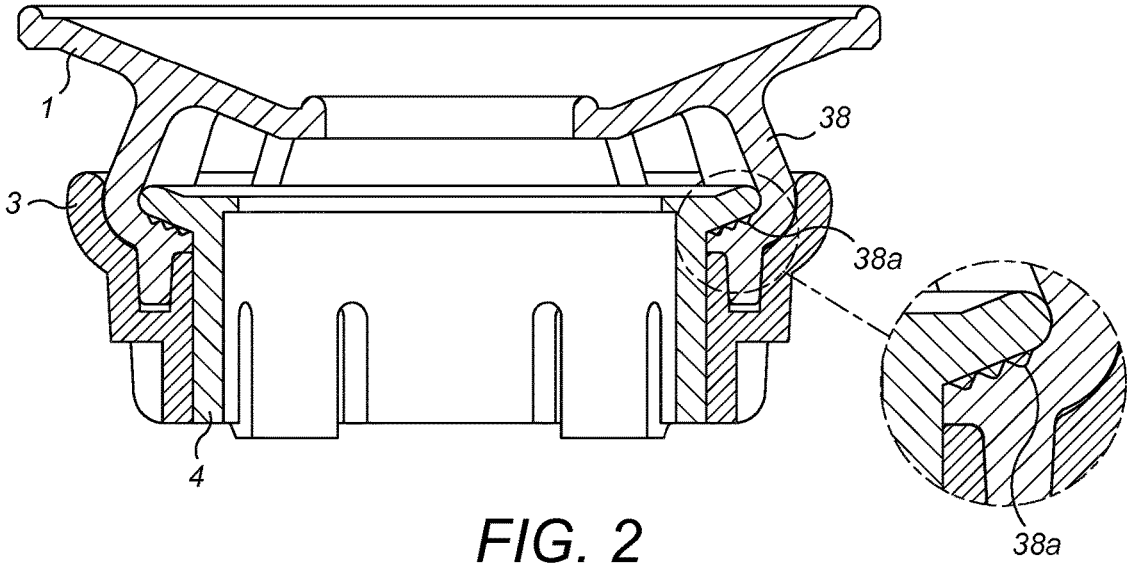
FIG. 2 shows a cross section view of the pump from FIG. 1A showing in more detail a portion of the pump.
Figure 3:
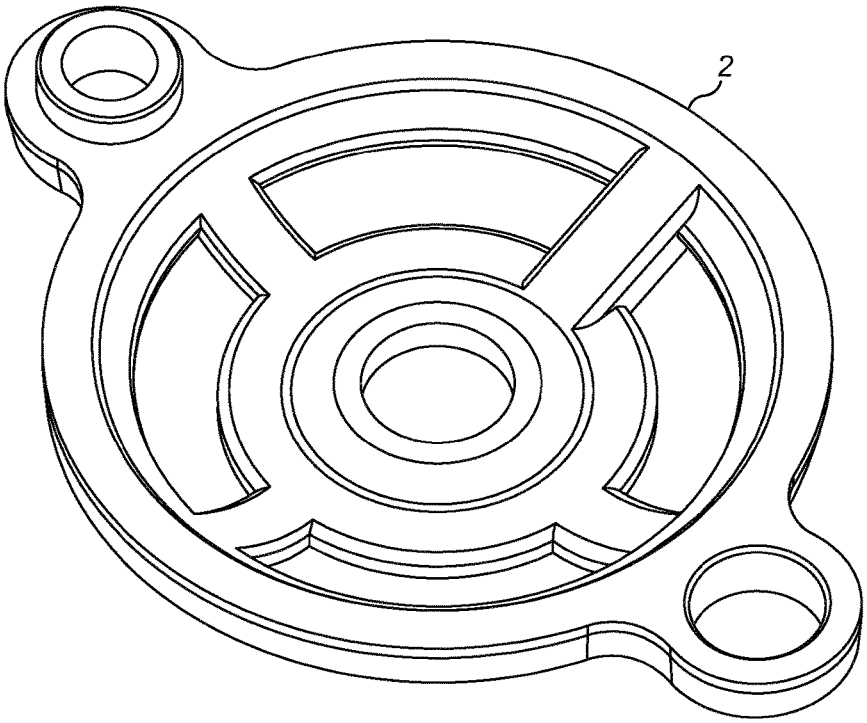
FIG. 3 shows a perspective view of the sealing ring.

The diaphragm 1 snap fits into engagement with the outer and inner clamp rings 3;4 from the swashplate assembly 50 by way of legs 38, as shown in FIG. 2 (for ease of reference, the sealing ring 2 is not shown in FIG. 2). If required, the legs 38 may comprise a series of protrusions or annular serrations 38*a* for engaging with corresponding recesses in the inner clamp ring 4 to improve the connection between the two components.

Figure 1D:
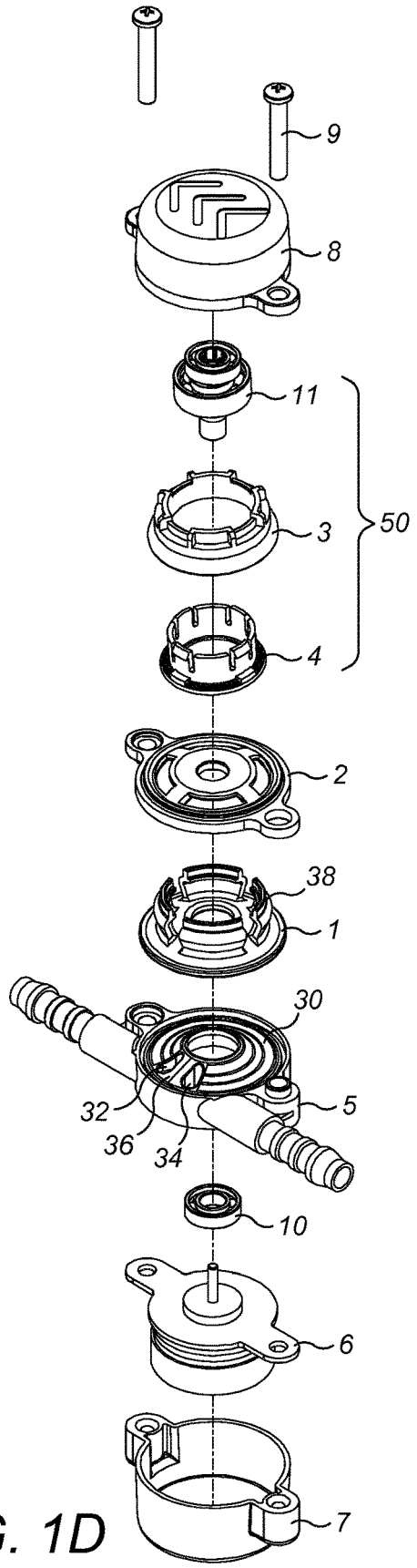
FIG. 1D shows an exploded perspective view of the pump from FIG. 1A.
Figure 1E:
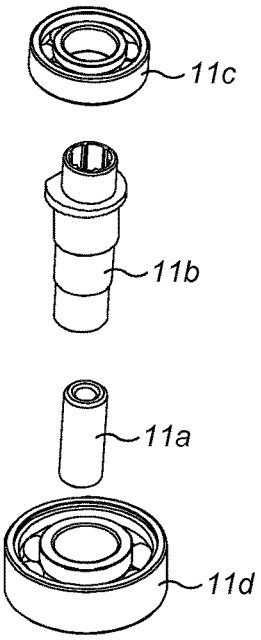
FIG. 1E shows an exploded perspective view of a portion of the pump from FIG. 1A.

To maximise the amount of control that the swashplate assembly 50 has on the diaphragm 1, the legs 38 extend around as much of a circumference of the diaphragm 1 as possible, as shown best in FIG. 1D.

To ensure that the legs 38 can connect the diaphragm 1 with the swashplate assembly 50, the sealing ring 2 comprises a set of corresponding circumferential slots which match the locations of the legs 38.

A motor 6 is rotatably coupled to the eccentric shaft assembly for rotating it in use as will be described. The eccentric shaft assembly comprises four sub-components. The first component is a tube 11*a* which connects with the motor shaft. The tube is preferably made of a flexible material, for instance silicone, to increase its durability. Surrounding this tube is a cylinder 11*b* with an eccentric outer surface. Surrounding the cylinder 11*b* are three bearings; bearing 10 connects the shaft assembly 11 to the central circular portion 5; bearing 11*c* connects the shaft assembly 11 to the pump, and bearing 11*d* connects the shaft to the inner clamp ring 4.

During use of the pump, the tube 11*a* helps to reduce the amount of radial shock load that is transmitted to the bearing 10.

To provide protection to the working parts of the pump, the bottom of the pump comprises a cover 7 which engages with the central circular portion 5 to cover the motor 6. The pump also includes a top cover 8 which engages with the central circular portion 5 to cover the swashplate assembly 50. The top cover 8 also functions to secure the sealing ring 2 in position. As shown in FIGS. 1A-1D, two screws 9 are used to connect the top cover 8, the central circular portion 5 and sealing ring 2 together.

Operation of the pump is best shown with reference to FIG. 1B. Initially, the components from the pump are assembled as shown in FIG. 1D.

In its assembled state, the motor 6 is operated causing the tube 11*a* and the eccentric cylinder 11*b* to rotate. As the cylinder 11*b* rotates, the eccentric outer surface of the cylinder 11*b* causes the outer and inner clamp rings 3;4 (which are connected to this cylinder 11*b*) to act as a swashplate 50 inside the pump. Because the outer and inner clamp rings 3;4 are connected to the diaphragm 1 by the legs 38, the diaphragm 1 moves in unison with the swashplate 50. The legs 38 are connected to the mid-region of the diaphragm 1 to provide maximum displacement of the diaphragm 1 as the swashplate moves, since the innermost and outermost regions of the diaphragm 1 are fixed in position by the remaining parts of the pump.

When an angular portion of the swashplate 50 is in its uppermost position, the corresponding angular portion of the diaphragm 1 is pushed into engagement with the channel wall 30 (see the left hand side of FIG. 1B). As the motor and the swashplate rotate, the position of the uppermost portion of the diaphragm (which is in contact with the channel wall 30) moves precessively around the channel. In so doing, any fluid contained between the diaphragm and the channel wall 30 and which is in an angular position ahead of this uppermost portion is pushed around the channel.

Because a portion of the diaphragm is always in contact with the channel wall 30, the inlet of the pump is always fluidly isolated from the outlet. Because of this, the pump does not need to have separate inlet or outlet valves. As well as simplifying the design of the pump, by not having such valves, the pump is bi-directional.

The invention claimed is:

1. A rotary pump having a housing defining an annular chamber with an inlet port and outlet port which are located on either side of a partition extending across the chamber;

a flexible annular diaphragm forming one side of the chamber facing a wall on the housing forming the second side of the chamber, the diaphragm being sealed at its innermost and outermost edges to the housing;

legs which are integral with the diaphragm, extending away from the diaphragm, and extending azimuthally around the diaphragm;

a swashplate assembly comprising inner and outer clamp rings connected to the legs of the diaphragm such that in use, movement of the swashplate causes the diaphragm to press precessively against the wall of the housing to force fluid drawn in at the inlet port on one side of the partition around the chamber and to expel it at the outlet port at the other side of the partition; and a sealing ring between the swashplate assembly and the diaphragm.

2. A rotary pump according to claim 1, wherein the sealing ring comprises an opening through which the swashplate assembly connects with the diaphragm.

3. A rotary pump according to claim 1, wherein the swashplate assembly is connected to the diaphragm by a snap-fitting of the inner and outer clamp rings.

4. A rotary pump according to claim 1, wherein the wall on the housing forming the second side of the chamber is tapered towards the swashplate assembly.

5. A rotary pump according to claim 1, further comprising a rotatable shaft for moving the swashplate assembly.

6. A rotary pump according to claim 5, wherein the swashplate assembly is coupled to the shaft via an eccentric bearing which is eccentric to the rotation axis of the shaft.

7. A rotary pump according to claim 5, wherein the shaft is coupled to the housing via a coupling bearing.

8. A rotary pump according to claim 5, wherein the shaft further comprises a tube member for rotatably connecting the shaft to a motor.

9. A rotary pump according to claim 8, wherein the tube member is made of a flexible material.

* * * * *